United States Patent [19]

Harris et al.

[11] Patent Number: 4,625,455

[45] Date of Patent: Dec. 2, 1986

[54] GATE OPERATING MECHANISM

[76] Inventors: Robert W. Harris, 625 NE. 41st St., Seattle, Wash. 98107; William R. Weber, 4200-50th Ave. NE., Seattle, Wash. 98105

[21] Appl. No.: 766,720

[22] Filed: Aug. 19, 1985

[51] Int. Cl.[4] ..... E05F 11/28

[52] U.S. Cl. ..... 49/281; 49/300; 49/345

[58] Field of Search ..... 49/281, 285, 293, 295, 49/298, 300, 302, 339, 345, 279, 280; 292/139; 126/197

[56] References Cited

U.S. PATENT DOCUMENTS

| | | | |
|---|---|---|---|
| 1,141,849 | 6/1915 | Stickley | 49/298 |
| 4,327,522 | 5/1982 | Meadows | 49/279 |
| 4,488,380 | 12/1984 | Howse | 49/279 |

*Primary Examiner*—William E. Lyddane
*Assistant Examiner*—Gerald A. Anderson

[57] ABSTRACT

A swinging gate operating mechanism having a crank and links which withdraw and insert the locking bolt as the linkages pass over center, and aligning linkage centers to allow the mechanism to rotate freely with a pair of indexing links to prevent the gate from rebounding out of the latch as the bolt impacts the jam post.

2 Claims, 4 Drawing Figures

GATE OPERATING MECHANISM

BACKGROUND OF INVENTION

1. Field of Invention

This invention relates to swinging gate operating mechanisms, particularly the opening, closing and locking of gates by the use of external links.

2. Prior Art

Gate operations, of the external arm type in general, use a rotary actuator with a crank and link to move the gate. These operators generally lock the gate closed by an overcenter position of the crank and link. This locking means is unsatisfactory as the gate itself can be used as a lever to easily fail the crank and link. To overcome this, solenoid operated bolts are being used to secure the gate at the latch post. Using solenoids is undesirable as electrical power has to be provided at the jam post. Gates locked in this manner have a tendency to rebound out of the latch as the bolt impacts the jam post on closing, leaving the gate unlocked.

Another method of locking gates is to use a spring loaded rocking dog, or some type of rotary device which rotates in and out of a latch as the gate is open or closed. These devices have the same failing as the solenoid method. To overcome this problem, gates with this sort of latching mechanism must be operated rather slowly which is a distinct disadvantage. The present invention is an improvement over the prior art by its unique ability to prevent the gate from rebounding regardless of gate speed. This is accomplished by a pair of indexing links which prevent the gate from rebounding during the latching phase of the gate operation. Gate operating speed is very important. In some cases it is necessary to close a gate quickly to prevent illegals from slipping through as the gate is closing.

Another advantage of the present invention is its unique latching feature. The bolt lug and latch are so arranged that the gate cannot be pried open by bending the jam post away from the gate.

SUMMARY OF INVENTION

The present invention applies to gate operating mechanisms, particularly to external arm mechanisms for opening swinging type gates. The power means is usually mounted on a support from the hinge post, and the crank arm and its drag link are connected to a sliding bolt with an indexing link mounted on the crank arm and another indexing link attached to the gate.

As the mechanism opens the gate, it first slides the bolt to open and then aligns two pivots in the linkage allowing the mechanism to swing the gate open, or closed, without binding.

The mechanism can be furnished as a package to be mounted on most swinging gates.

DESCRIPTION OF INVENTION

Figures 1, 2:
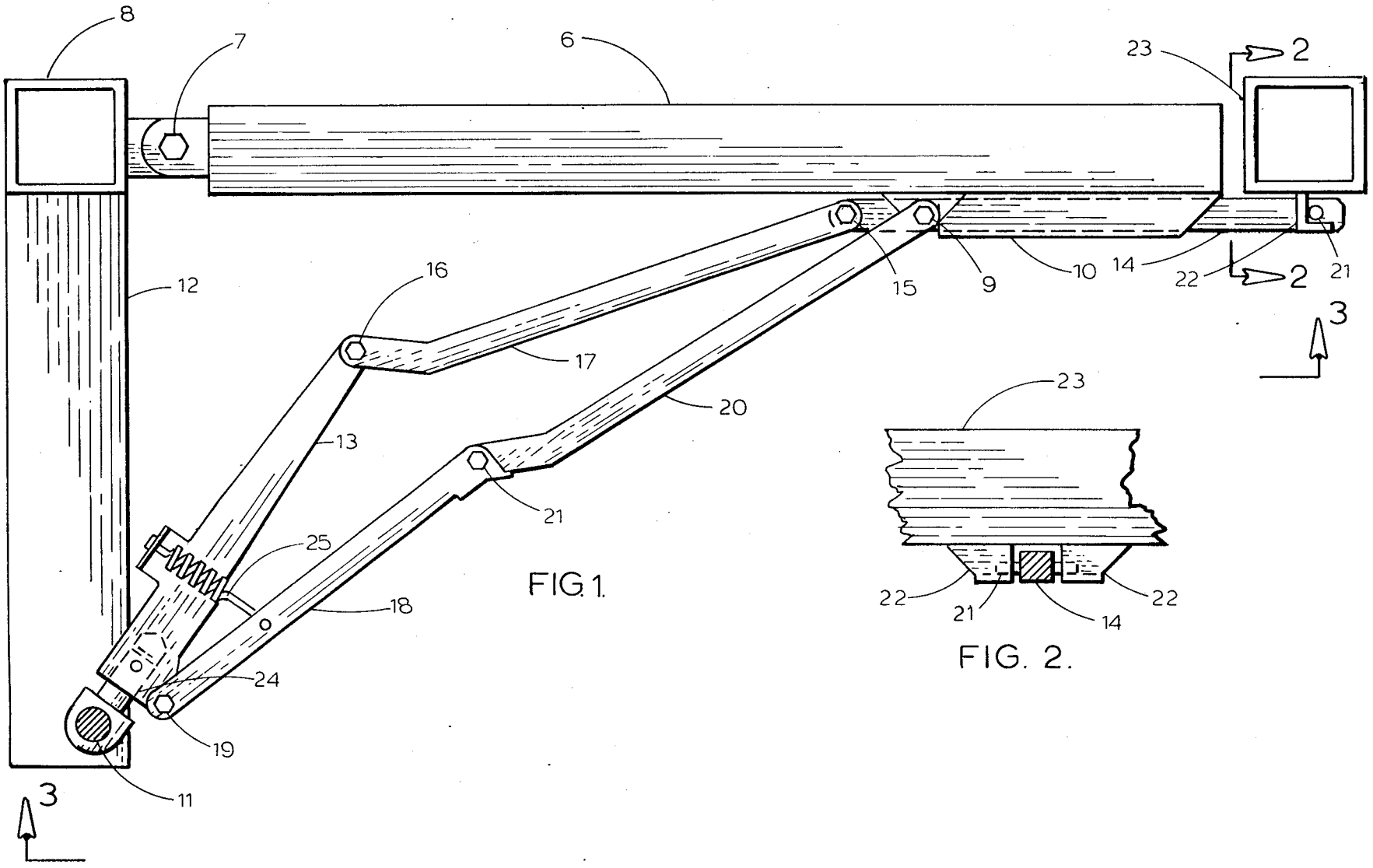
FIG. 1 is a plan view of the present invention attached to a gate 6 with the bolt 14 in the locked, or latched, position.
FIG. 2 is a section view depicting the bolt and the method of attaching the latch 22 to the jam post.

The drawings illustrate by way of example, not by way of limitation, one form of the preferred embodiment of the invention wherein all reference numerals designate corresponding parts in the several views. With reference to FIGS. 1 and 2, there is illustrated a usual swinging gate 6, pivoting at 7 from hinge post 8. The drive means 11, supported by member 12, has secured to it a crank arm 13 which is connected to a slidable bolt 14, by the drag link 17 at pivots 15 and 16. An index link 18 is pivoted on the crank arm 13 at 19 with a second index link 20 connected at pivots 21 and 9. Index link 18 has an overcenter stop at pivot 21. The bolt is shown with its lug 21 in the locked position in latch 22. The latch is permanently attached to the jam post 23. Overcenter spring 24 is extended between link 18 and crank arm 13. Crank arm 13 has an inserted rod 24 which allows the length of the crank arm 13 to be adjusted for different gate 6 opening angles.

Figure 3:
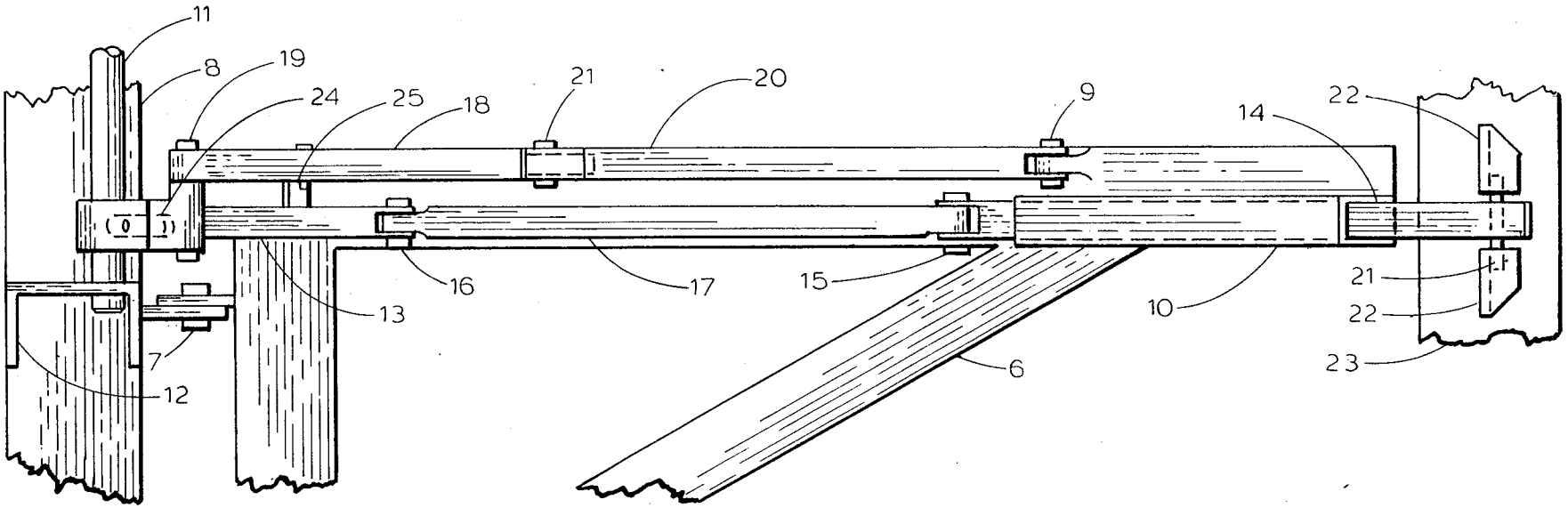
FIG. 3 is an elevation view looking toward the "outside."

Referring to FIG. 3, the crank arm 13, drag link 17 and links 18 and 20 are shown in a possible configuration in elevation.

Figure 4:
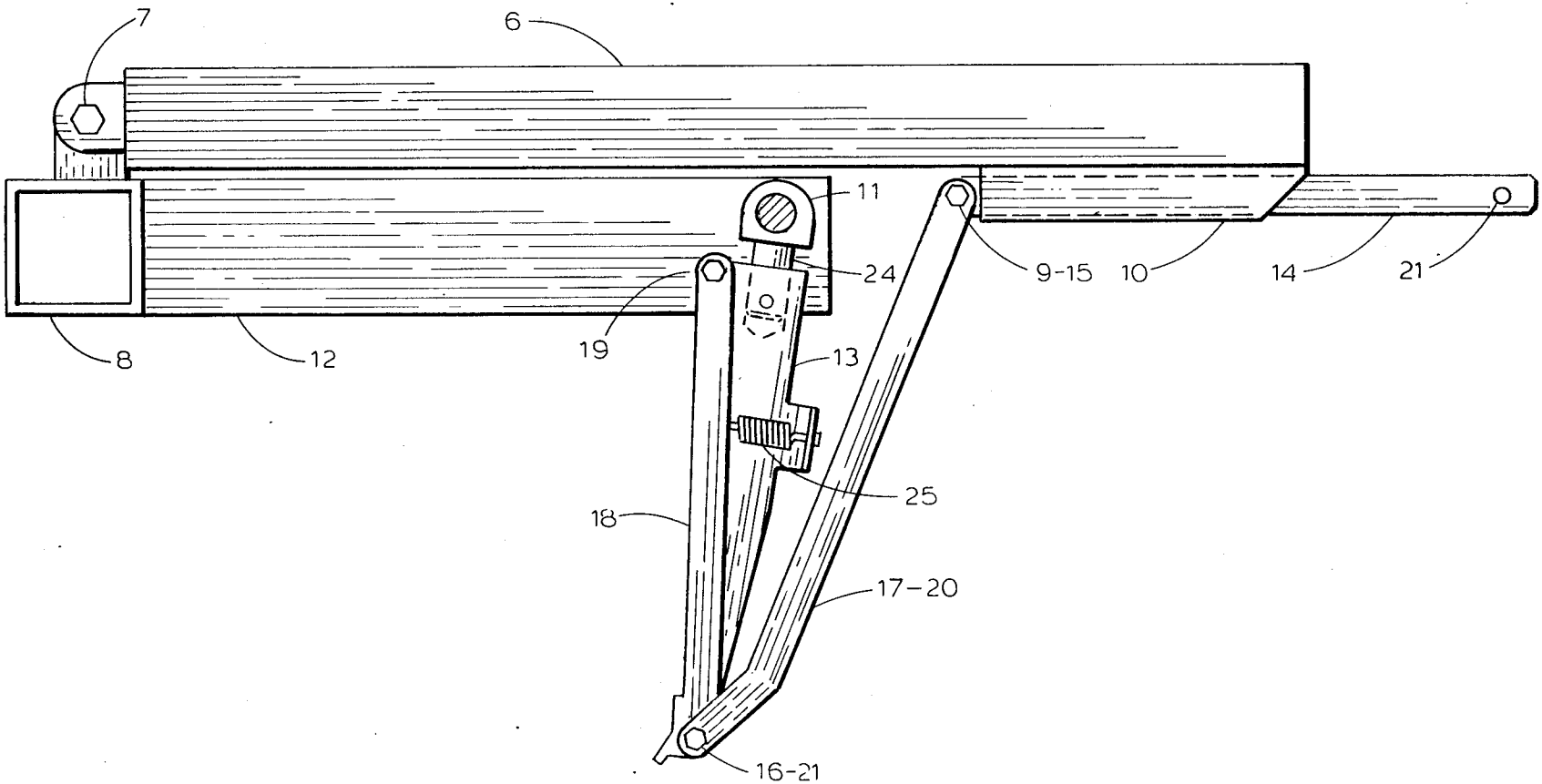
FIG. 4 is a plan view of gate 6 and operating mechanism in the gate open position.

Referring to FIG. 4, the gate 6 is shown in the open position in a plan view. It should be noted that pivots 16 and 21 and pivots 9 and 15 are aligned.

Referring again to FIG. 1, the power means 11 rotates crank arm 13 clockwise which rotates pivots 16 toward the overcenter position, forcing drag link 17 to push the sliding bolt 14, in guide 10, to the right, allowing lug 21 to clear latch 22 and starts the gate 6 toward the open position while the index links 18 and 20 rotate overcenter at pivot 21. As the crankarm 13 continues to rotate clockwise, pivots 16 and 21 align and pivots 15 and 9 align to allow the linkage to continue operating to the gate 6 open position, shown in FIG. 4, without binding. To close the gate 6, from the open position shown in FIG. 4, crankarm 13 rotates counterclockwise driving the gate 6 through the drag link 17 and index links 18 and 20 until the bolt 14, which is extended to the right, strikes the jam post 23 at which time the index link pivot 21 is passing over center, to prevent the gate 6 from rebounding, as the crank arm 13 and drag link 17's pivot 16 passes over center, pulling the bolt 14 to the left into latch 22. Indexing links 18 and 20 have an overcenter spring 25 to hold them overcenter. This overcenter spring 25 is a nicety, not required as the index links 18 and 20 are able to restrain the rebounding without pivot 21 being absolutely overcenter. To change the angle of gate 6 opening the crank arm 13 is extended or retracted on bar 24 and pinned in place.

Latching bolt 14 to jam post 23 could be done in one of several ways, however; the method illustrated is unique as it prevents unlatching the gate by prying the jam post to the right.

For this and other reasons, it can be stated that, while the preferred embodiments of the invention have been herein described and illustrated, it should be understood that various modifications and alterations may be made without departing from the spirit of the invention or scope as defined by the appended claims.

Now, therefore, we claim:

1. A gate operating mechanism comprising:

a. a crank arm attached to a drive means at one end with a drag link, pin connected, at the other end;

b. said drag link, pin connected to a sliding bolt operating in a guide attached to the gate;

c. a first index link pivotally mounted on the crank arm and pin connected to a second index link;

d. said second index link, pin connected to the gate;

e. said crank arm and drag link, when the drive means rotates to open the gate, pushes the sliding bolt free of a latch as a drag link common center passes over center alinging the said drag link common center with an index link common center and aligning the drag link pin connection at the sliding bolt with the index pin connection at the gate to allow the mechanism to open the gate fully without binding;

f. said drag and crank link, when the drive means rotates to close the gate, pushes the gate closed and pulls the sliding bolt into the latch as the drag link common center passes over center and as the index common center pases over center to restrain the gate from rebounding as the sliding bolt impacts a jam post.

2. A gate operating mechanism as claimed in claim 1 wherein said crank arm is made extensible, between drive means pivot and index arm pivotal mount, to allow adjustment of the gate opening angle.

* * * * *